US010913231B2

(12) United States Patent
Marsh

(10) Patent No.: US 10,913,231 B2
(45) Date of Patent: Feb. 9, 2021

(54) MACHINE FOR FORMING CONTAINERS

(71) Applicant: INTERNATIONAL PAPER COMPANY, Memphis, TN (US)

(72) Inventor: Nathan Marsh, Clark, CO (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 247 days.

(21) Appl. No.: 16/156,073

(22) Filed: Oct. 10, 2018

(65) Prior Publication Data

US 2020/0114611 A1 Apr. 16, 2020

(51) Int. Cl.

| | |
|---|---|
| ***B31B 50/00*** | (2017.01) |
| ***B31B 50/30*** | (2017.01) |
| *B31B 120/30* | (2017.01) |
| *B31B 50/62* | (2017.01) |
| *B31B 110/35* | (2017.01) |
| *B31B 120/70* | (2017.01) |

(52) U.S. Cl.

CPC ..... *B31B 50/005* (2017.08); *B31B 50/30* (2017.08); *B31B 50/624* (2017.08); *B31B 2110/35* (2017.08); *B31B 2120/302* (2017.08); *B31B 2120/70* (2017.08)

(58) Field of Classification Search

CPC ..... B31B 50/44; B31B 50/005; B31B 50/30; B31B 2100/00

See application file for complete search history.

(56) References Cited

U.S. PATENT DOCUMENTS

| | | | | |
|---|---|---|---|---|
| 3,097,576 | A | 7/1963 | Burke | |
| 4,308,023 | A * | 12/1981 | Bidegain | B31B 50/00 493/176 |
| 5,147,271 | A * | 9/1992 | Bacques | B65D 5/001 493/176 |
| 2012/0238425 | A1* | 9/2012 | Costanzo, Jr. | B65D 25/205 493/128 |
| 2014/0228191 | A1* | 8/2014 | Frank | B31B 50/26 493/52 |
| 2015/0087491 | A1* | 3/2015 | Langen | B65B 43/305 493/162 |
| 2019/0111649 | A1* | 4/2019 | Johnson | B25J 9/0087 |
| 2019/0160774 | A1* | 5/2019 | Langen | B31B 50/722 |

FOREIGN PATENT DOCUMENTS

| | | | |
|---|---|---|---|
| DE | 1922832 | U | 9/1965 |
| DE | 192283211 | U | 9/1965 |
| DE | 1256049 | B | 12/1967 |
| EP | 3033281 | A1 | 6/2016 |
| EP | 3263324 | B1 | 4/2019 |
| FR | 1551882 | | 9/2016 |
| FR | 3033281 | A3 | 9/2016 |
| WO | WO2015069009 | A1 | 5/2015 |

* cited by examiner

*Primary Examiner* — Andrew M Tecco
*Assistant Examiner* — Eyamindae C Jallow
(74) *Attorney, Agent, or Firm* — Michael D. Folkerts; Thomas W. Ryan

(57) ABSTRACT

A machine is provided that forms blanks of fiberboard material into containers. The machine includes a frame structure, a mandrel assembly, and a carriage assembly. One or both of the mandrel assembly or the carriage assembly can be easily removed from the frame structure such that another mandrel and/or carriage assembly having different dimensions can be easily installed in the place of the removed mandrel and/or carriage assembly.

23 Claims, 11 Drawing Sheets

MACHINE FOR FORMING CONTAINERS

FIELD OF THE INVENTION

This invention relates generally to machines that form blanks of material (e.g., fiberboard) into containers or trays.

BACKGROUND OF THE INVENTION

Containers fabricated from fiberboard, e.g., corrugated fiberboard, paperboard or corrugated paperboard, are often used to store and transport goods. Such containers may be formed from a blank of sheet material (hereinafter "blank"), which is folded along a plurality of preformed fold lines and glued to form an erected container, also referred to as a "tray."

Machines are well-known in the art to form such containers. An exemplary prior art forming machine comprises a tray forming machine illustrated in U.S. Pat. No. 4,988,331, assigned to Vega Automation, the entire disclosure of which is hereby incorporated by reference herein.

In such a tray forming machine, blanks are fed one at a time to a forming station comprising a mandrel assembly and a carriage assembly. The mandrel assembly is moved relative to the carriage assembly and is inserted into an opening defined by forming elements or forming shoes of the carriage assembly. A blank is placed over the opening prior to insertion of the mandrel assembly into the opening to form an erected container with dimensions dictated by the shape of a mandrel of the mandrel assembly.

SUMMARY OF THE INVENTION

In accordance with one aspect of the present disclosure, a machine is provided that forms blanks of fiberboard material into containers. The machine includes removable and interchangeable first and second sets of forming components and receives one of the first set of forming components or the second set of forming components in a first forming station for use during a forming operation. The first set of forming components comprises a first mandrel assembly and a first carriage assembly. The first mandrel assembly comprises: an elongate first post having opposed first and second end portions, the first end portion including at least one first attachment member adapted to interact with at least one second attachment member on a first frame element of a frame structure of the machine so as to releasably secure the first mandrel assembly to the first frame element; and a first mandrel member affixed to the second end portion of the first post, the first mandrel member comprising a first size and shape. The first carriage assembly is adapted to be secured to a second frame element of the frame structure of the machine. The first carriage assembly comprises a plurality of first forming elements that collectively form a first opening having dimensions corresponding to the first size and shape of the first mandrel member. The second set of forming components comprises a second mandrel assembly and a second carriage assembly. The second mandrel assembly comprises: an elongate second post having opposed first and second end portions, the first end portion including at least one third attachment member adapted to interact with the at least one second attachment member on the first frame element so as to releasably secure the second mandrel assembly to the first frame element; and a second mandrel member affixed to the second end portion of the second post, the second mandrel member comprising a second size and shape different than the first size and shape. The second carriage assembly is adapted to be secured to the second frame element of the machine. The second carriage assembly comprises a plurality of second forming elements that collectively form a second opening having dimensions corresponding to the second size and shape of the second mandrel member. One of the first set of forming components or the second set of forming components is coupled to the first forming station of the machine by: securing the at least one first or the at least one third attachment member of the respective first or second post to the at least one second attachment member of the first frame element of the machine; and securing the corresponding first or second carriage assembly to the second frame element of the machine. The installed one of the first or the second set of forming components is used during operation of the machine to form blanks of fiberboard material into containers having dimensions corresponding to the first or the second size and shape of the installed first or second mandrel member.

The first and second posts may each comprise a rigid member that is arranged generally vertically when installed in the machine, and the first frame element of the machine comprises an elongate generally horizontal beam member.

The at least one first attachment member may comprise a first mounting member comprising at least one first opening, the at least one second attachment member may comprise a second mounting member including at least one second opening and the at least one third attachment member may comprise a third mounting member comprising at least one third opening.

The at least one first attachment member may further comprise a fastener that passes through the at least one second opening and threadedly engages the at least one first opening to couple the first mounting member to the second mounting member.

The at least one first attachment member further may comprise a plate coupled to the first mounting member, the plate comprising at least one bore and the at least one second attachment member may further comprise at least one pin extending from the second mounting member such that the at least one pin passes through the at least one bore to couple the first mounting member to the second mounting member.

Each of the first and second carriage assemblies may comprise a base frame and rollers coupled to the base frame.

The machine may further comprise tracks provided on the frame structure for receiving the rollers of the first and second carriage assemblies to allow the carriage assemblies to be easily inserted into and removed from the frame structure.

The machine may further comprise a clamp assembly comprising a first clamp element mounted to each of the base frames of the first and second carriage assemblies and a second clamp element mounted to the second frame element, such that the first or the second carriage assembly is secured to the second frame element of the machine using the clamp assembly.

The machine may further comprise a second forming station located adjacent to the first forming station for receiving another set of forming components.

The size and shape of the first mandrel member may be matched with the size and shape of the first opening of the first carriage assembly and the size and shape of the second mandrel member may be matched with the size and shape of the second opening of the second carriage assembly such that, when the first or the second set of forming components is installed in the machine, no alignment modifications of the first or the second mandrel assembly and its corresponding first or second carriage assembly are required for the machine to form blanks of material into containers.

In accordance with a second aspect of the present disclosure, a machine is provided that forms blanks of fiberboard material into containers. The machine comprises a frame structure and a mandrel assembly. The mandrel assembly comprises: an elongate post having opposed first and second end portions, the first end portion including at least one first attachment member coupled with at least one second attachment member on a first frame element of the frame structure so as to releasably secure the mandrel assembly to the first frame element; and a first mandrel member affixed to the second end portion of the first post.

The at least one first attachment member may comprise a first mounting member comprising at least one first opening and the least one second attachment member may comprise a second mounting member including at least one second opening.

The at least one first attachment member may further comprise a fastener that passes through the at least one second opening and threadedly engages the at least one first opening to couple the first mounting member to the second mounting member.

The at least one first attachment member may further comprise a plate coupled to the first mounting member, the plate comprising at least one bore, and the at least one second attachment member may further comprise at least one pin extending from the second mounting member such that the at least one pin passes through the at least one bore to couple the first mounting member to the second mounting member.

In accordance with a third aspect of the present disclosure, a machine is provided that forms blanks of fiberboard material into containers. The machine comprises: a frame structure; a mandrel assembly coupled to a first frame element of the frame structure and comprising a mandrel member having a first size and shape; and a carriage assembly releasably secured to a second frame element of the frame structure. The carriage assembly comprises a removable base frame to which a plurality of first forming elements are coupled and that collectively form an opening having dimensions corresponding to the first size and shape of the mandrel member.

The machine may further comprise a clamp assembly comprising a first clamp element mounted to the base frame of the carriage assembly and a second clamp element mounted to the second frame element, such that the carriage assembly is secured to the second frame element via the clamp assembly.

The carriage assembly may further comprise rollers coupled to the base frame.

The frame structure may further comprise tracks for receiving the rollers of the carriage assembly to allow the carriage assembly to be easily inserted into and removed from the frame structure.

The plurality of first forming elements may be coupled only to the base frame and not directly coupled to the frame structure.

In accordance with a fourth aspect of the present disclosure, a method of modifying a machine that forms blanks of fiberboard material into formed containers is provided. A first mandrel assembly is removed from a first frame element of a frame structure of the machine. The first mandrel assembly comprises: an elongate first post having opposed first and second end portions, the first end portion including at least one first attachment member that is removably coupled to at least one second attachment member coupled to the first frame element so as to releasably secure the first mandrel assembly to the first frame element; and a first mandrel member affixed to the second end portion of the first post, the first mandrel member comprising a first size and shape. The first mandrel assembly is removed from the first frame element by decoupling the at least one first attachment member from the at least one second attachment member. A second mandrel assembly is secured to the at least one second attachment member of the first frame element of the machine. The second mandrel assembly comprises: an elongate second post having opposed first and second end portions, the first end portion including at least one third attachment member that is capable of being removably coupled to the at least one second attachment member of the first frame element so as to releasably secure the second mandrel assembly to the first frame element; and a second mandrel member affixed to the second end portion of the second post, the second mandrel member comprising a second size and shape different than the first size and shape. The second mandrel assembly is secured to the first frame element by coupling the at least one third attachment member to the at least one second attachment member.

The first post may be a different post from the second post.

In accordance with a fifth aspect of the present disclosure, a method of modifying a machine that forms blanks of fiberboard material into formed containers is provided. A first carriage assembly is removed from a frame structure of the machine. The first carriage assembly comprises a removable first base frame to which a plurality of first forming elements are coupled and that collectively form a first opening having dimensions corresponding to a size and shape of a corresponding first mandrel member. The first carriage assembly is removed from the frame structure by withdrawing the first base frame with the plurality of first forming elements coupled to the first base frame from the frame structure such that the first forming elements do not need to be individual decoupled from the frame structure. A second carriage assembly is secured to the frame structure of the machine in place of the first carriage assembly. The second carriage assembly comprises a removable second base frame to which a plurality of second forming elements are coupled and that collectively form a second opening having dimensions corresponding to a second size and shape of a corresponding second mandrel member. The second carriage assembly is secured to the frame structure by inserting the second base frame with the plurality of second forming elements coupled to the second base frame into the frame structure and securing the second base frame to the frame structure such that the second forming elements do not need to be individual secured to the frame structure or positionally adjusted on the second base frame.

The first carriage assembly may be removed from the frame structure of the machine by rolling the first carriage assembly on rollers and the second carriage assembly may be inserted into the machine in place of the first carriage assembly by rolling the second carriage assembly on rollers.

The rollers may be provided on the frame structure.

The rollers may be provided on the first and second base frames.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
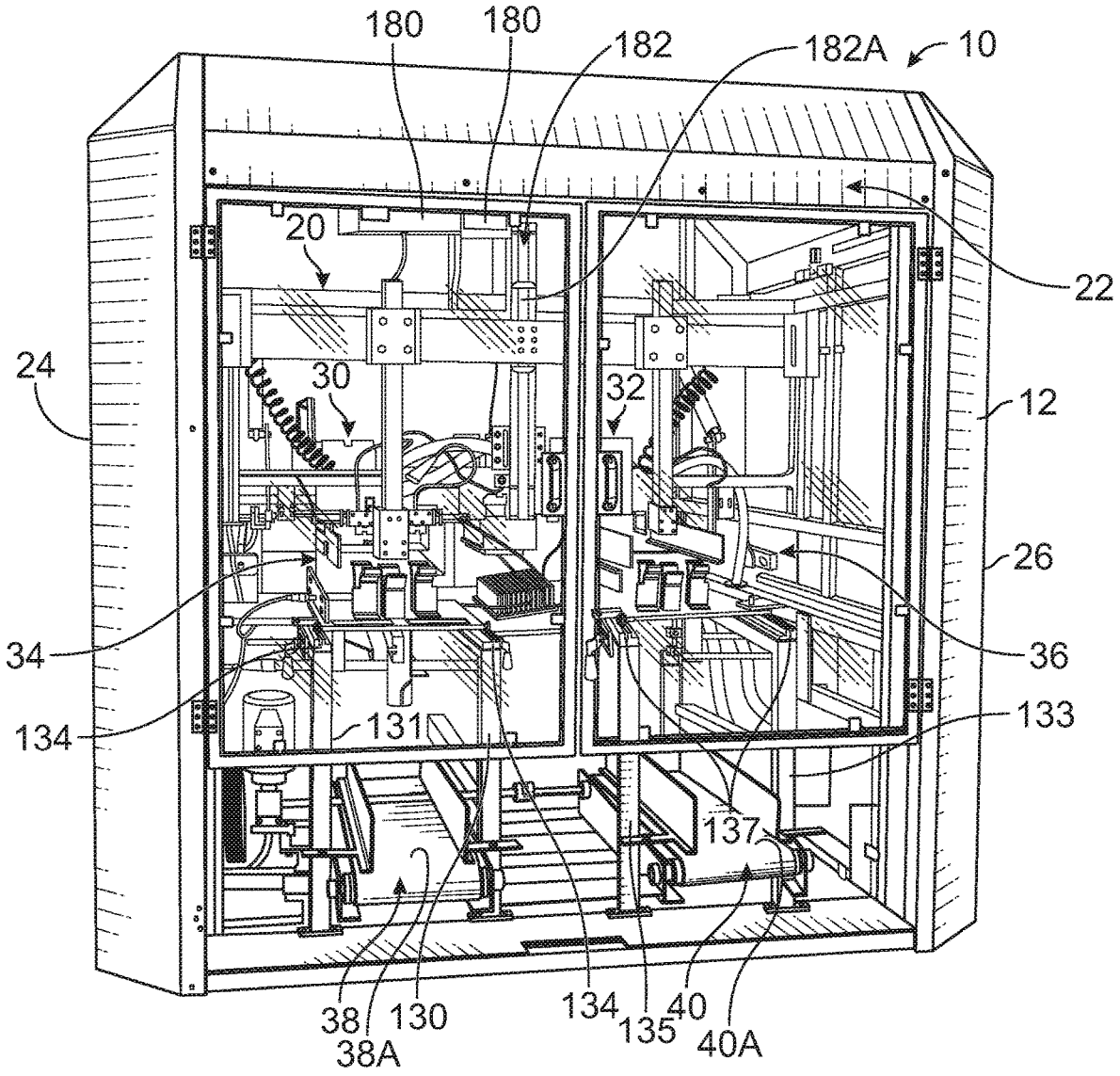
FIG. 1 is a view of a machine for forming containers according to the present invention, as seen from a discharge side of the machine.
Figure 11:
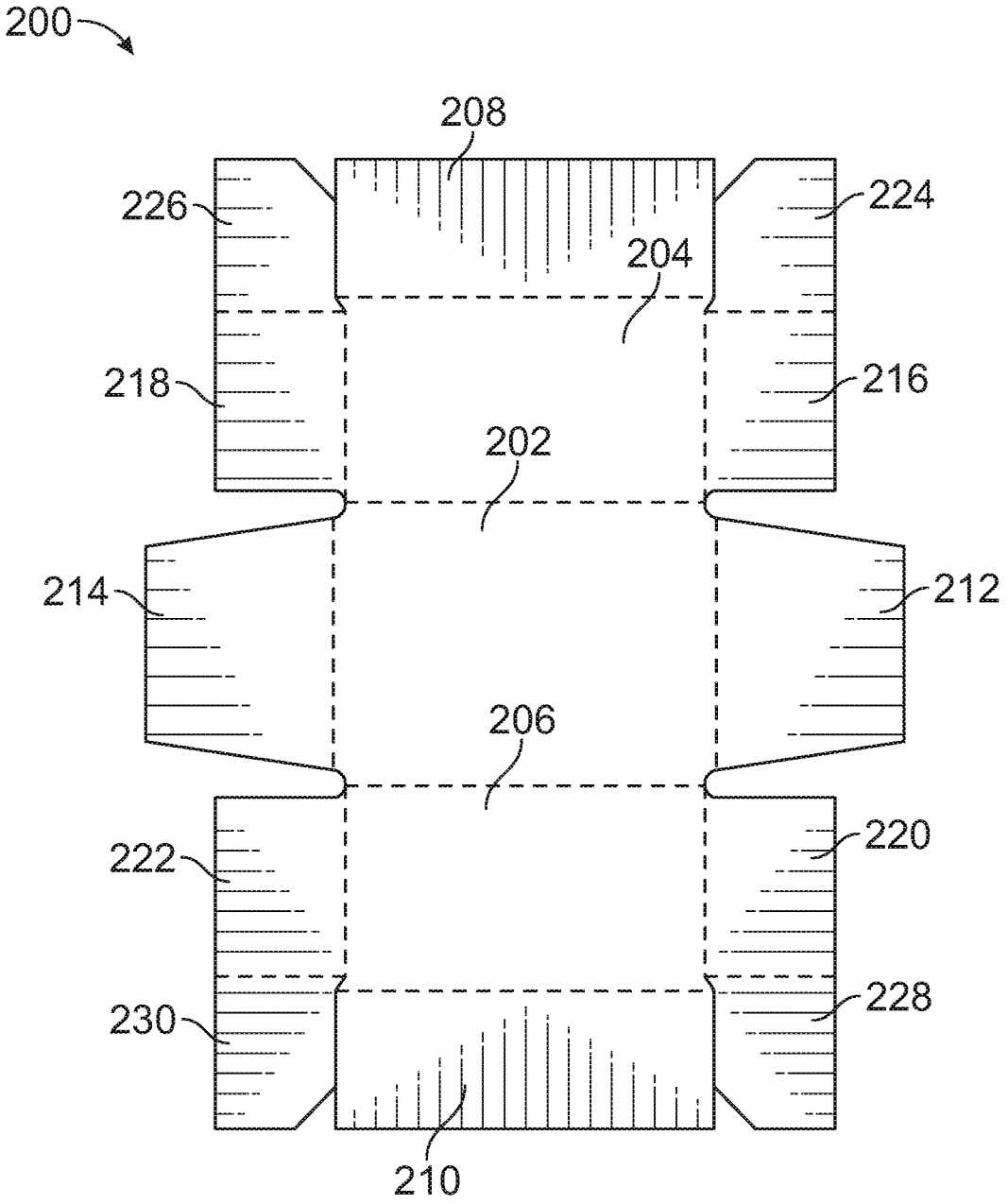
FIG. 11 is view of an exemplary blank that can be formed into a formed container by the machine of FIG. 1.

With reference to FIG. 1, a machine 10 constructed in accordance with the present disclosure is used to form erected boxes or containers from generally flat blanks of fiberboard material, e.g., corrugated fiberboard, paperboard or corrugated paperboard, hereinafter referred to as "blanks." One such blank 200 is illustrated in FIG. 11. The machine 10 comprises a frame structure 12 that will be described in more detail herein.

The machine 10 includes a feed end 20 (the back of the machine 10 as illustrated in FIG. 1), a discharge end 22 (the front of the machine 10 as illustrated in FIG. 1), and first and second sides 24, 26 spanning between the feed and discharge ends 20, 22. Blanks are loaded into hoppers 30, 32 located at the feed end 20 of the machine 10. The blanks, which are generally stacked in vertical orientations in the hoppers 30, 32, are supplied from the hoppers 30, 32 to respective first and second forming stations 34, 36 in a manner well-known in the art. In the illustrated embodiment, a picking mechanism comprising vacuum gripping members, grips a blank in each hopper 30, 32, removes the two blanks from the hoppers 30, 32 and rotates the blanks to a generally horizontal position, where the blanks are positioned on guide rails. A mechanical pusher mechanism then moves each of the blanks horizontally to a position located in a corresponding one of the first and second forming stations 34, 36. While the machine 10 illustrated in FIG. 1 includes two forming stations 34, 36, the machine could include additional or fewer forming stations.

Once the blanks are supplied to the forming stations 34, 36, respective sets of removable and interchangeable forming components, which will be described in detailed herein, are used to form the blanks into erected containers during a forming operation. The formed containers are then discharged from the machine 10 via discharge assemblies 38, 40 comprising movable belts 38A and 40A in the illustrated embodiment located at the discharge end 22 of the machine 10.

Figure 8:
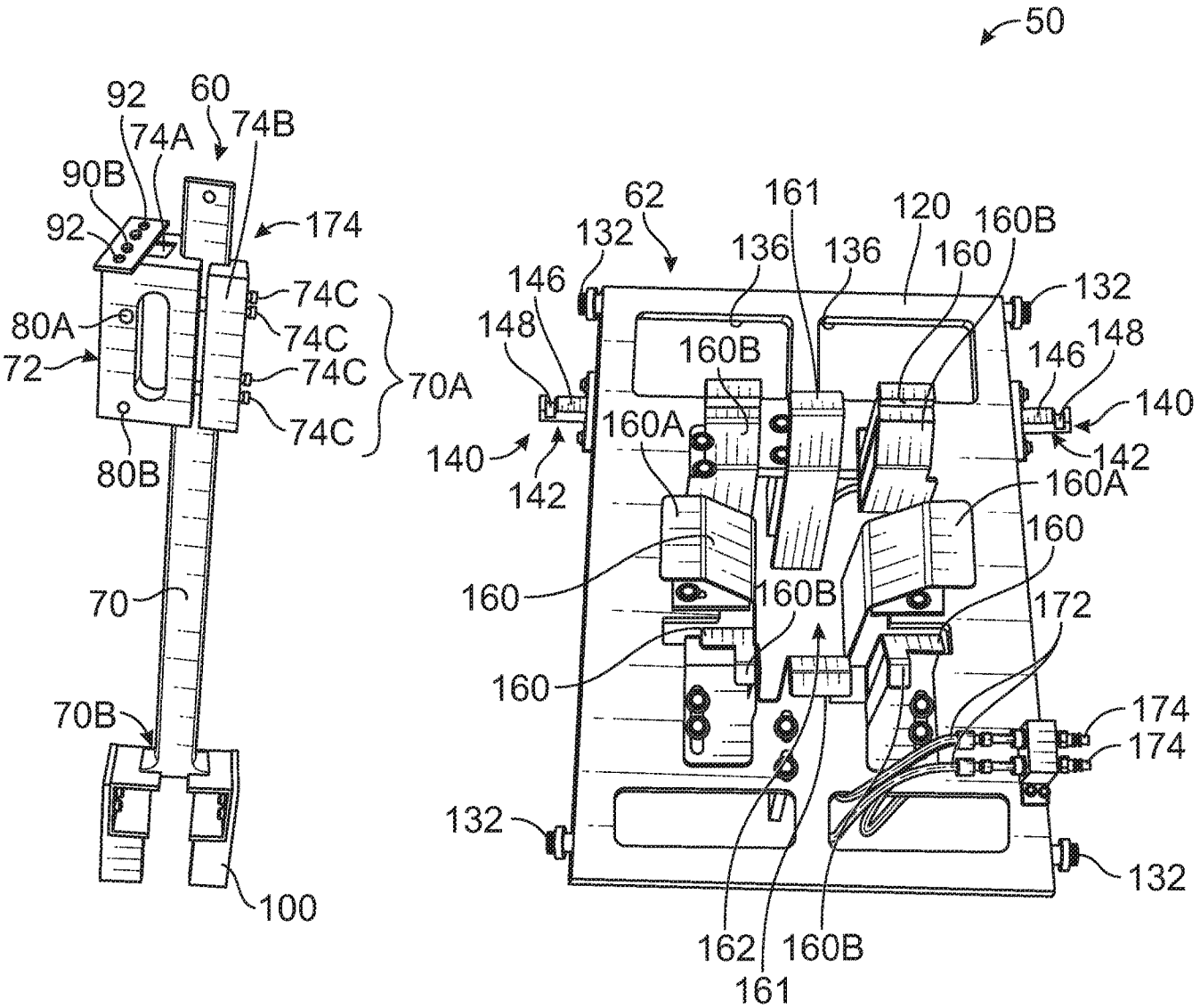
FIG. 8 is a view of a set of forming components in accordance with the present invention.
Figure 9:
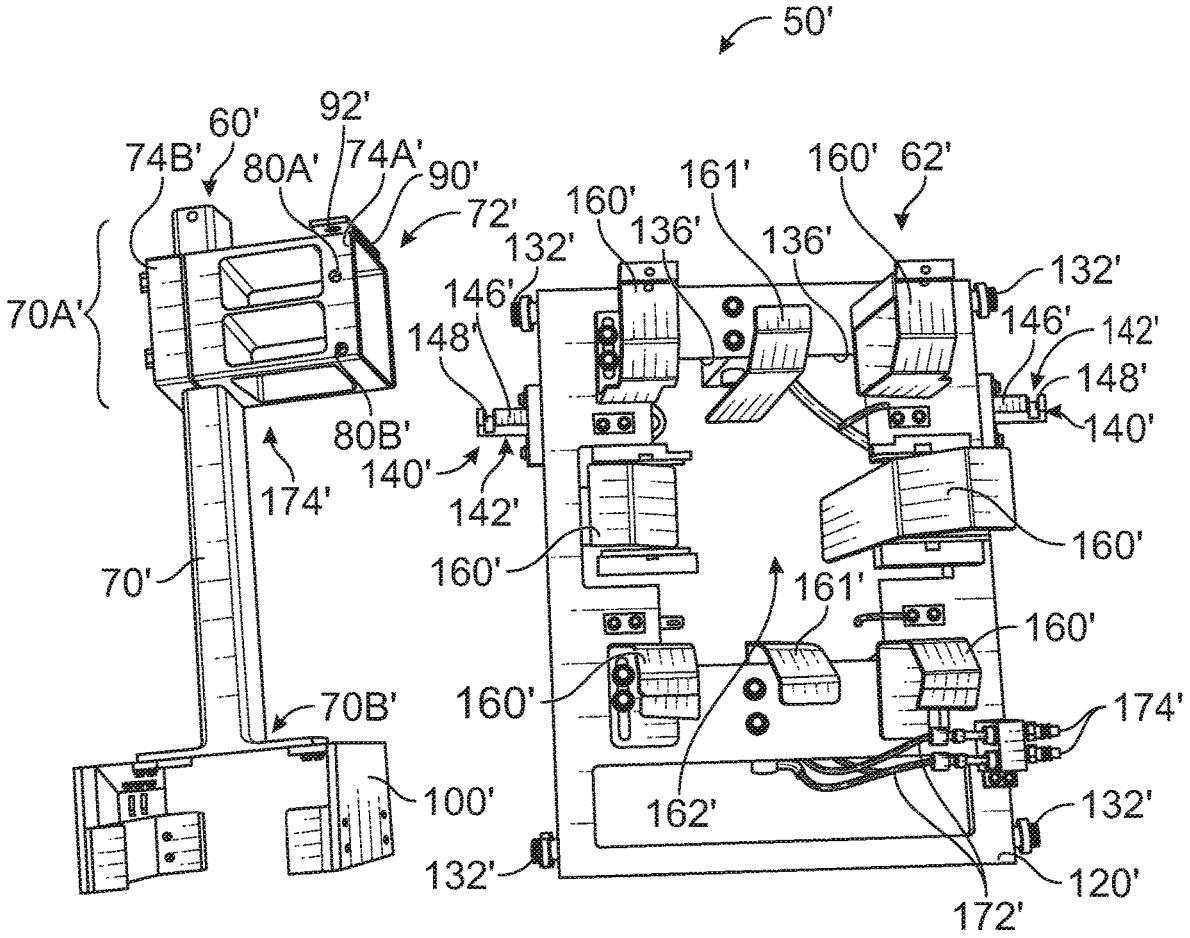
FIG. 9 is a view of another set of forming components in accordance with the present invention.

FIGS. 8 and 9 illustrate exemplary first (FIG. 8) and second (FIG. 9) sets of forming components 50, 50' in accordance with the invention, each of which will be described in turn herein.

The first set of forming components 50, shown in FIG. 8, includes a first mandrel assembly 60 and a first carriage assembly 62. As will be described in more detail below, the first mandrel assembly 60 and the first carriage assembly 62 form a matched set of first forming components 50, with components having sizes and dimensions that correspond to one another in accordance with an aspect of the disclosure.

Figure 10:
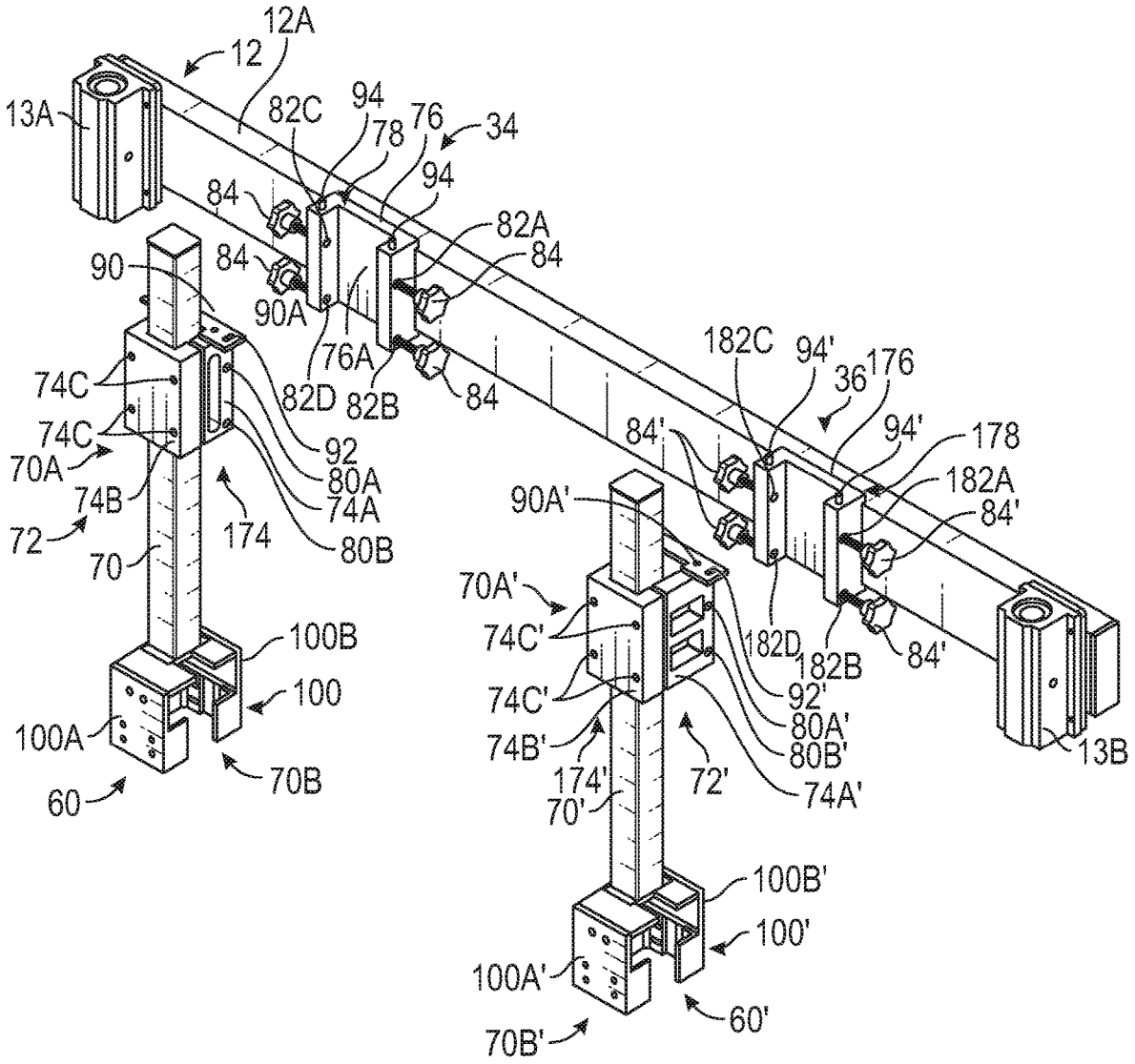
FIG. 10 is a perspective view of first and second mandrel assemblies and a frame element according to the present invention.

The first mandrel assembly 60 includes an elongate first post 70 comprising a rigid member and having opposed first and second end portions 70A, 70B, see FIGS. 8 and 10. The first end portion 70A includes at least one first attachment member 72 for removably attaching the first mandrel assembly 50 to the frame structure 12 of the machine 10.

In the exemplary embodiment shown in FIGS. 8 and 10, the at least one first attachment member 72 comprises a first mounting member 174 comprising a pair of first mounting member sections 74A, 74B, wherein the first mounting member sections 74A, 74B are positioned on opposing sides of the first post 70 and coupled together via bolts 74C so as to be releasably locked in position on the first post 70.

Figure 2:
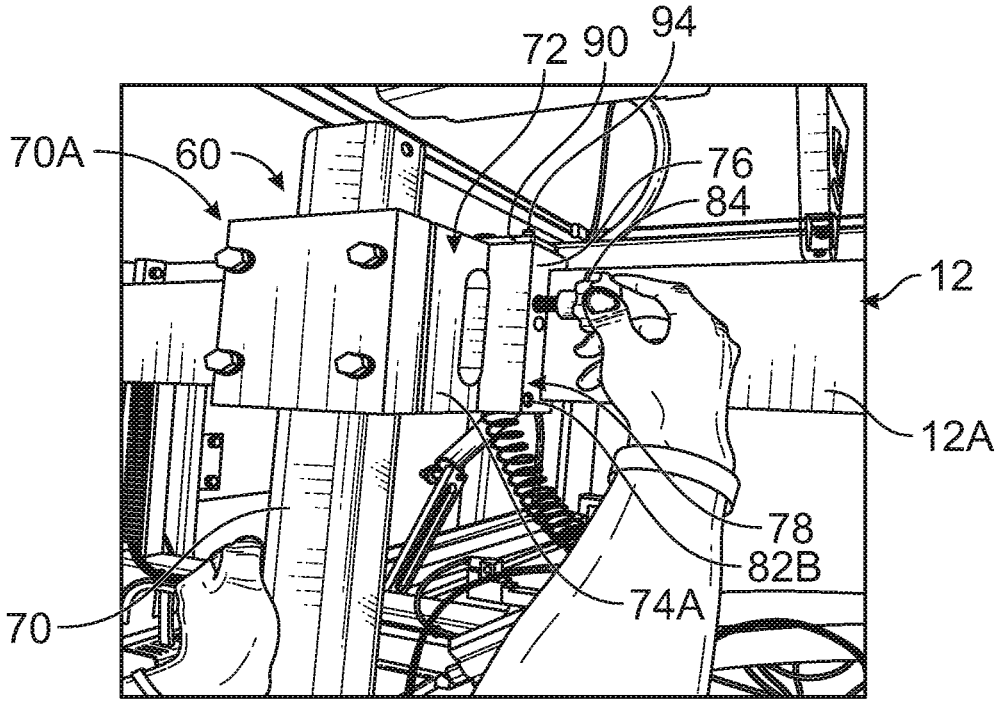
FIGS. 2 and 3 are perspective views illustrating steps for removing a mandrel assembly from a frame structure of the machine of FIG. 1.
Figure 3:
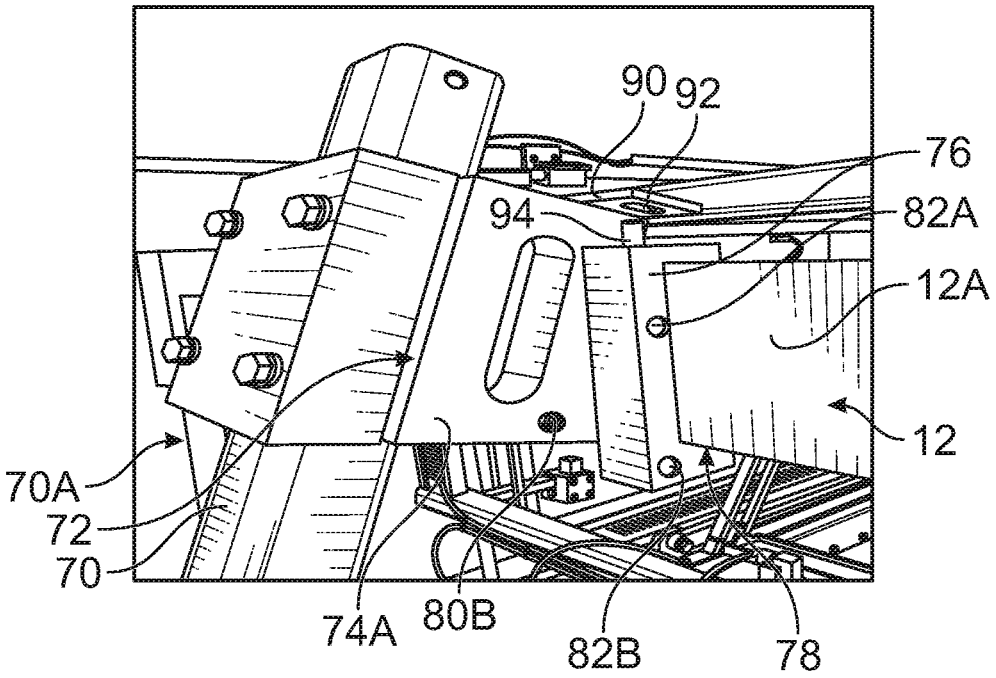

When the first mandrel assembly 60 is to be installed in the machine 10, the first mounting member 174 is adapted to interact with a second mounting member 76 of at least one second attachment member 78. The second mounting member 76 is coupled to a first frame element 12A of the frame structure 12 via bolts, welding, or the like, see FIGS. 2, 3 and 10. The second mounting member 76 comprises a recess 76A, which receives the first mounting member 174. The first frame element 12A comprises an elongate generally horizontal beam member that may span between the first and second sides 24, 26 of the machine.

The first mounting member 174, more specifically, the mounting member section 74A, comprises at least one first opening, e.g., two first openings 80A, 80B, as shown in FIGS. 8 and 10, and two additional first openings (not shown) on the opposite side of the mounting member section 74A. The second mounting member 76 includes a corresponding number of second openings 82A, 82B, 82C, 82D, see FIGS. 2, 3 and 10. The at least one first attachment member 72 further comprises threaded fasteners or bolts 84, see FIGS. 2 and 10, that pass through the respective second openings 82A, 82B, 82C, 82D in the second mounting member 76 and threadedly engage the respective first openings 80A, 80B in the first mounting member 174 to couple the first mounting member 174 to the second mounting member 76.

The at least one first attachment member 72 may further comprise a plate 90 coupled to the first mounting member 174, more specifically, to the mounting member section 74A, via bolts 90B (see FIG. 8; not shown in FIG. 10) that extend through openings 90A in the plate 90 and engage threaded openings in the first mounting member 174, more specifically, the mounting member section 74A, see FIGS. 2, 3, 8 and 10. The plate 90 further comprises at least one bore 92, two bores 92 in the illustrated embodiment. The at least one second attachment member 78 further comprises at least one pin 94, two pins 94 in the illustrated embodiment, that extend upwardly from the second mounting member 76 in the embodiment shown, wherein the pins 94 pass through the bores 92 to further couple the first mounting member 174 to the second mounting member 76.

The first and second attachment members 72, 78 are used to releasably secure the first mandrel assembly 60 to the first frame element 12A, wherein the first post 70 of the first mandrel assembly 60 is arranged generally vertically when installed in the machine 10.

The first mandrel assembly 60 further comprises a first mandrel member 100, see FIGS. 8 and 10. The first mandrel member 100 is affixed to the second end portion 70B of the first post 70, and comprises a first size and shape. The first size and shape of the first mandrel member 100 are set to or defined by the dimensions of containers to be erected by the first set of forming components 50. The first mandrel member 100 may be shaped and sized to form containers of any desirable size and shape. In one embodiment, the first mandrel member 100 forms containers having dimensions of from about 4"×3"×1½" to about 10"×7"×5". In general terms, the first mandrel member 100 takes the form of one or more rigid members such as spaced apart end plates or members 100A and 100B, see FIG. 10, that may define with their bottom surfaces an outline of an area generally corresponding to an outline of a bottom surface or floor of the container or box to be erected.

The first carriage assembly 62 of the first set of forming components 50 comprises a base frame 120. When the first set of forming components 50 is installed in the machine 10, the base frame 120 is secured to a second frame element 130 of the frame structure 12, see FIGS. 1, 6 and 7. The first carriage assembly 62 may be easily inserted into and removed from the frame structure 12 of the machine 10 via rollers 132 mounted to the base frame 120, which rollers 132 roll on corresponding tracks 134 on the second frame element 130 and another frame element 131 which is generally parallel to the second frame element 130. It is noted that the tracks 134 could be located on the base frame 120 with the rollers 132 on the frame elements 130 and 131 without departing from the scope and spirit of the invention. Cutout portions 136 formed in the base frame 120 may serve as handholds for moving the first carriage assembly 62 into and out of the machine 10.

Figure 5:
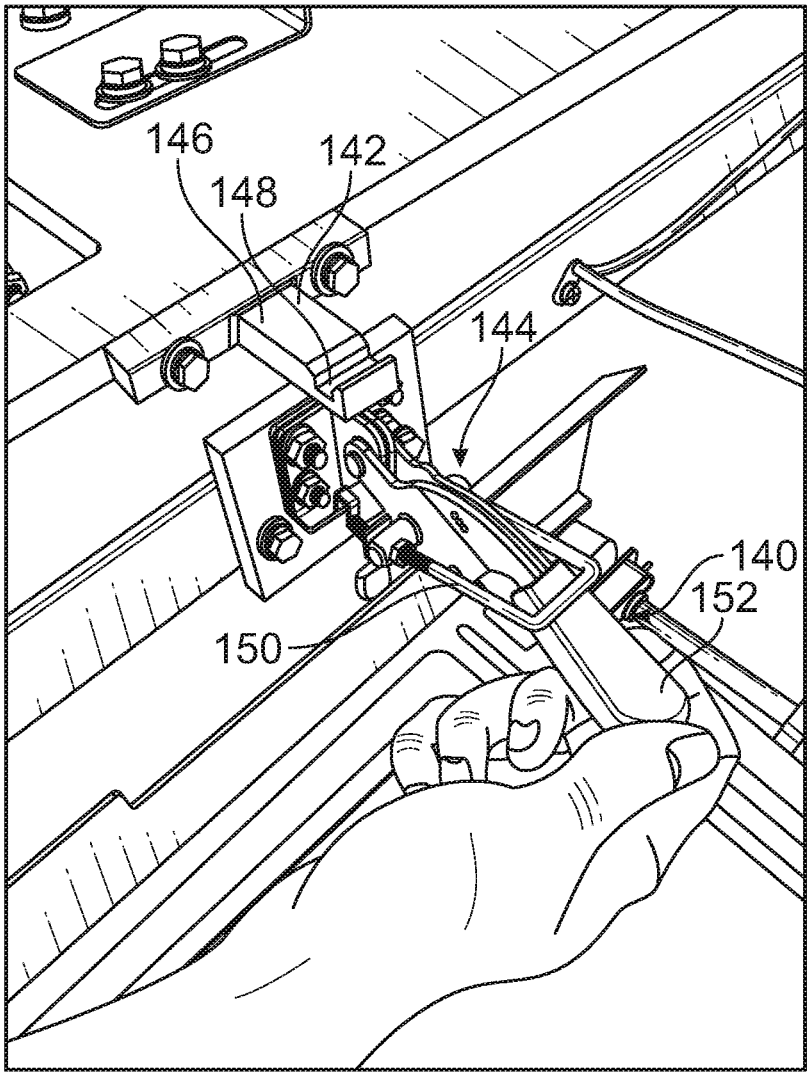
Figure 6:
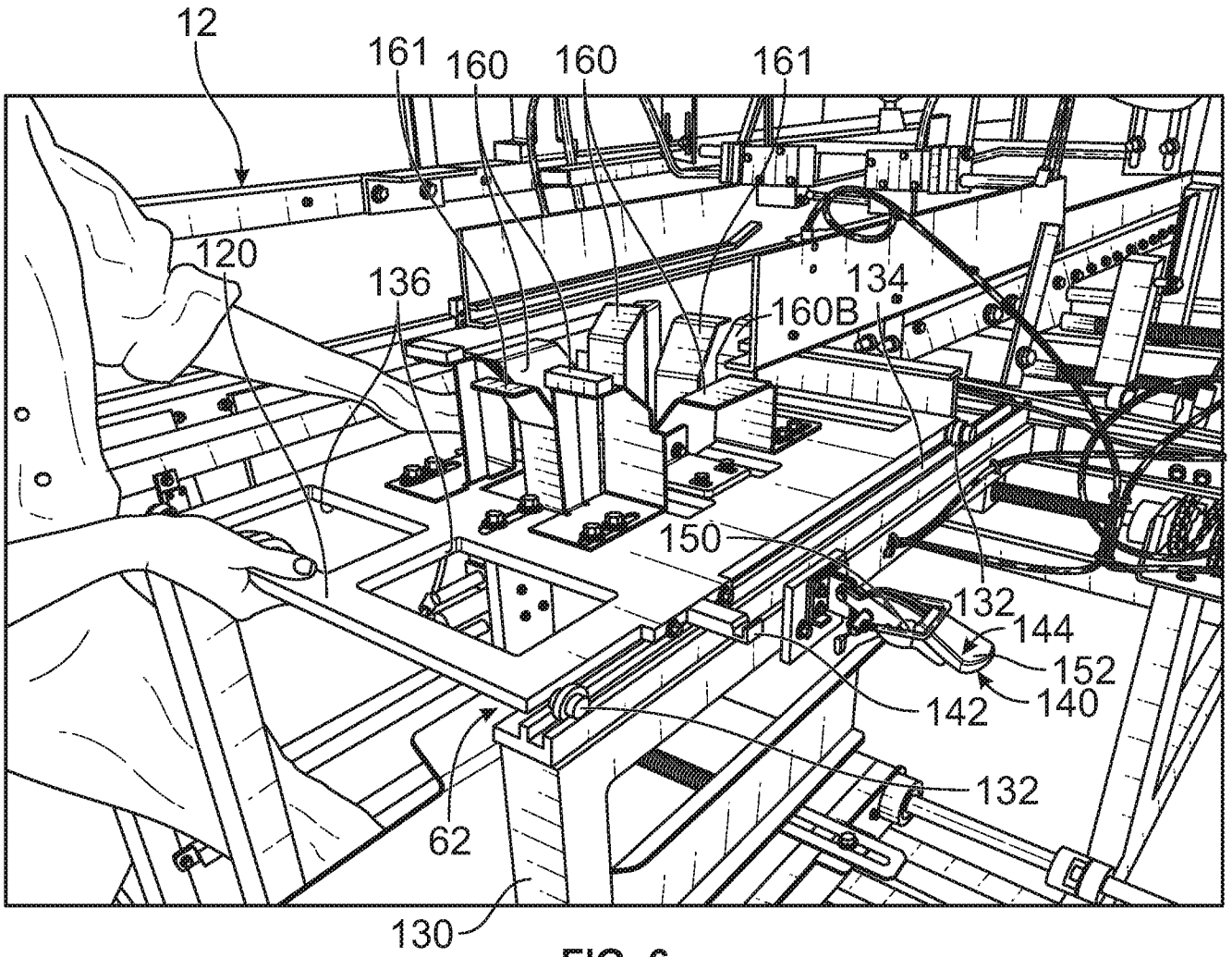
Figure 7:
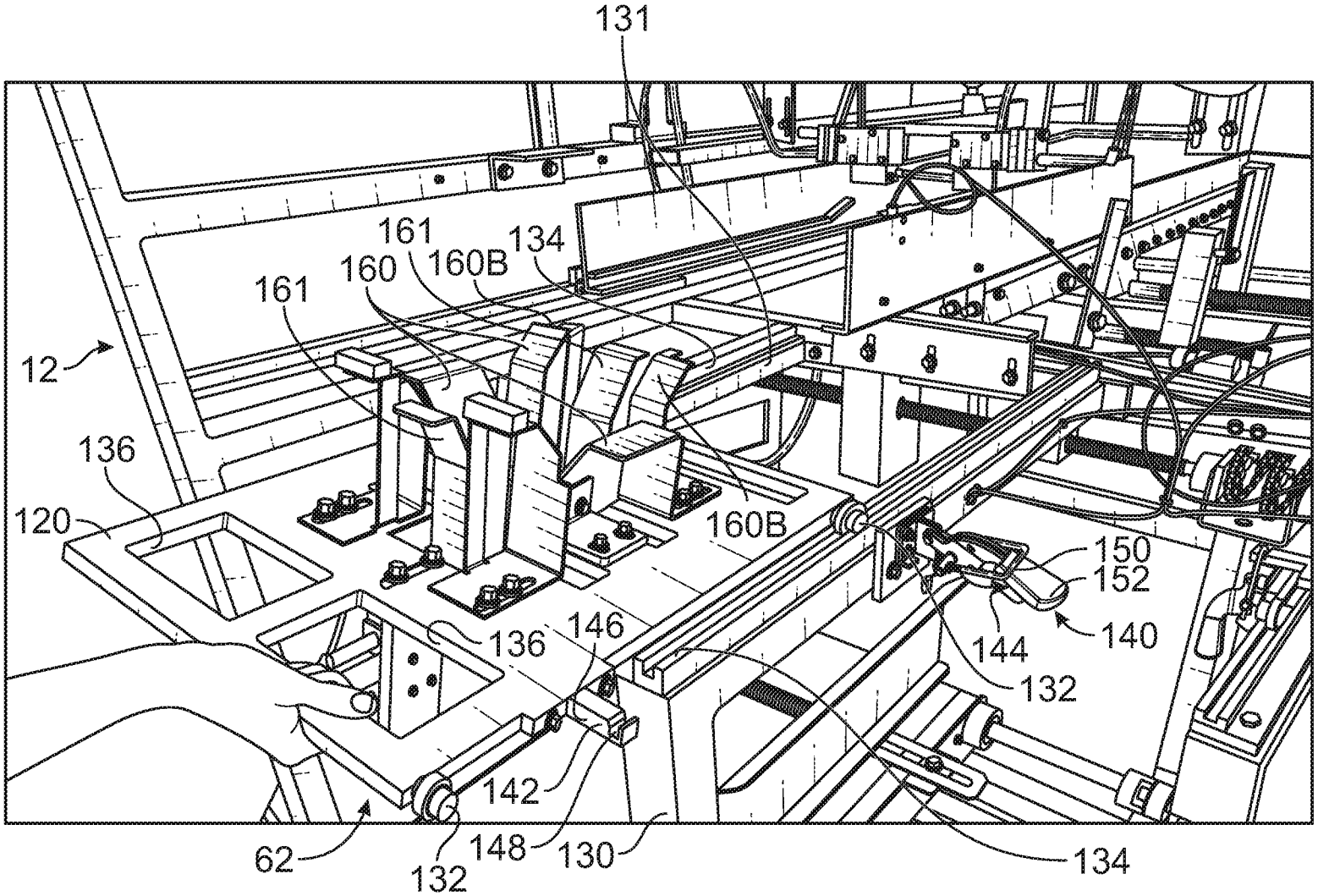

A clamp assembly 140 is used to releasably secure the first carriage assembly 62 to the second frame element 130, see FIGS. 5-7. The clamp assembly 140 comprises a first clamp element 142 fixedly mounted to the base frame 120, and a second clamp element 144 fixedly mounted to the second frame element 130. Any suitable clamp elements 142, 144 can be used, i.e., the invention is not meant to be limited to any particular type of clamp elements. In the exemplary embodiment shown, the first clamp element 142 comprises a rigid and elongate member 146 that includes a notch 148, which notch 148 is adapted to receive a U-shaped fastening member 150 of the second clamp element 144, see FIG. 5. Once the fastening member 150 is received in the notch 148, a pivoting handle 152 of the second clamp element 144 is rotated down to tighten the fastening member 150 in the notch 148 and therefore secure the first carriage assembly 62 to the second frame element 130. A second clamp assembly in a preferred embodiment is used to secure the other side of the first carriage assembly 62 to the other frame element 131 that is generally parallel to the second frame element 130. A second elongate member 146 is illustrated on the first carriage assembly 62 shown in FIG. 8, but not in FIGS. 6 and 7.

The first carriage assembly 62 further comprises a plurality of first passive forming elements 160 and first active forming elements 161, wherein the forming elements 160, 161 are also known in the art as forming shoes, which collectively form a first opening 162 having dimensions corresponding to the first size and shape of the first mandrel member 100 such that the first mandrel member 100 may pass at least part way through the first opening 162. The first forming elements 160 and 161 have a plurality of entry angles, which help move side walls of a blank to be formed into a container to an upright, vertical or erected position as the mandrel member 100 applies a downward force on a blank. Pneumatic piston and cylinders units (not shown) are located on the base frame 120 and coupled to the active forming elements 161 for moving the forming elements 161 toward and away from a center point of the first opening 162 during each container forming operation.

Coupled to opposing ends of the first frame element 12A are linear motion ball bearing bushings 13A and 13B, see FIG. 10, each of which moves along a corresponding shaft (not shown in FIG. 10) fixed to the frame structure 12. Also provided in the exemplary embodiment shown is a motor/gearbox assembly 180 (see FIG. 1) fixed to the frame structure 12. The motor/gearbox assembly 180 is coupled to a linear actuator assembly 182 comprising a screw (not shown) in a housing fixed to the frame assembly 12 and a moveable plate/nut assembly 182A, which moveable plate/nut assembly 182A moves along the screw vertically up and down as the motor/gearbox assembly 180 is actuated. The moveable plate/nut assembly 182A is coupled to the first frame element 12A for movement with the assembly 182A. When the moveable plate/nut assembly 182A is moved up or down along the screw in the vertical direction when the motor/gearbox assembly 180 is actuated, it causes the first frame element 12A and the first mandrel assembly 60 to reciprocate upward and downward with it. In an alternate embodiment, the motor/gearbox assembly 180 and linear actuator assembly 182 are replaced with a pneumatic cylinder and rod structure.

During operation of the machine 10, a blank is moved by the mechanical pusher mechanism over the first carriage assembly 62. The motor/gearbox assembly 180 is then actuated causing the movable plate/nut assembly 182A to move downward, resulting in the first mandrel assembly 60 also moving downward. Downward movement of the first mandrel assembly 60 causes the first mandrel member 100 to apply a downward force on the blank forcing the blank through the first opening 162 in the first carriage assembly 62. As the blank moves through the first opening 162, the first forming elements 160 and 161 cause side walls of the blank to be erected into an upright, vertical or erected position so as to form the blank into a container having its upper portion open.

Figure 12:
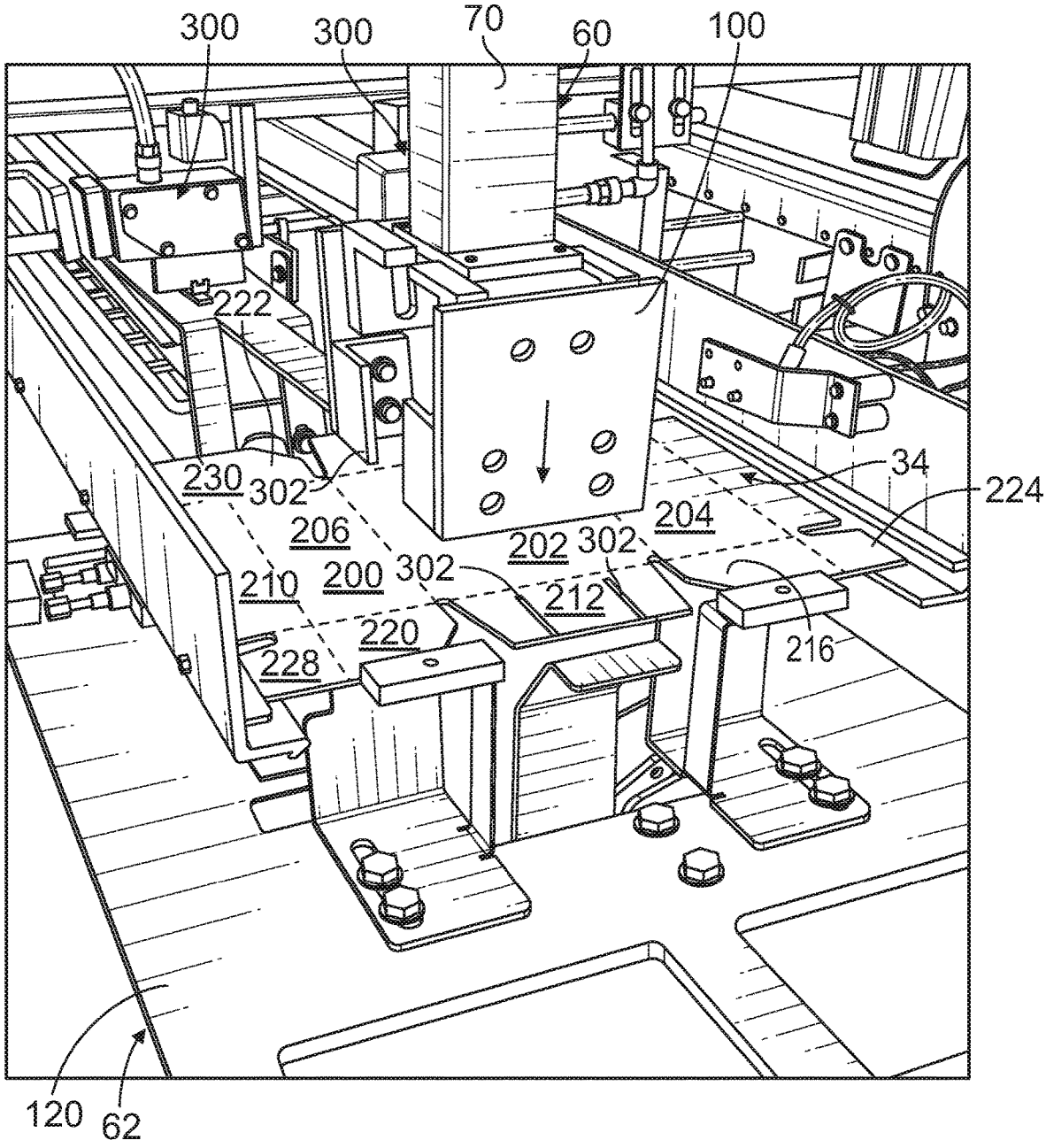
FIG. 12 is a perspective view illustrating a blank that is about to be formed into a formed container by the machine of FIG. 1.

In one embodiment, the blank 200, illustrated in FIG. 10, comprises a bottom wall 202, a first side wall 204, a second side wall 206, a first top flap 208, a second top flap 210, a first end wall 212, a second end wall 214, a first lateral side wall 216, a second lateral side wall 218, a third lateral side wall 220, a fourth lateral side wall 222, a first lateral top flap 224, a second lateral top flap 226, a third lateral top flap 228, and a fourth lateral top flap 230. The blank 200 is formed into a container by the first mandrel assembly 60 and the first carriage assembly 62 as follows. In FIG. 12, the blank 200 is shown positioned in the first forming station 34 over the first carriage assembly 62. Just before the blank 200 reaches the first forming station 34, first and second adhesive application stations 300 positioned within the machine 10 apply two parallel lines of adhesive 302 on each of the first and second end walls 212 and 214. As the first mandrel member 100 moves downward, it pushes the blank 200 into the first opening 162 of the first carriage assembly 62. As the blank 200 moves downward, the blank 200 is first engaged at its first and second side walls 204 and 206 by first passive side forming elements 160A, which extend vertically higher than first passive end forming elements 160B, see FIG. 8. As the blank 200 continues movement downward, the first, second, third and fourth lateral side walls 216, 218, 220, 222 are folded inward by the first passive end forming elements 160B. Once the blank has completed its downward movement via the mandrel member 100, the first active forming elements 161 are actuated causing the first and second end walls 212 and 214 to be folded inward to engage and adhesively couple to the first, second, third and fourth lateral side walls 216, 218, 220 and 222. The first and second top flaps 208 and 210 and the first, second, third and fourth lateral top flaps 224, 226, 228, and 230 are not folded to a closed position by the machine 10 but are left open to allow the box to be filled after exiting the machine 10.

As shown in FIGS. 6-8, the first forming elements 160 and 161 are coupled only to the base frame 120 and not directly coupled to the frame structure 12.

Figure 4:
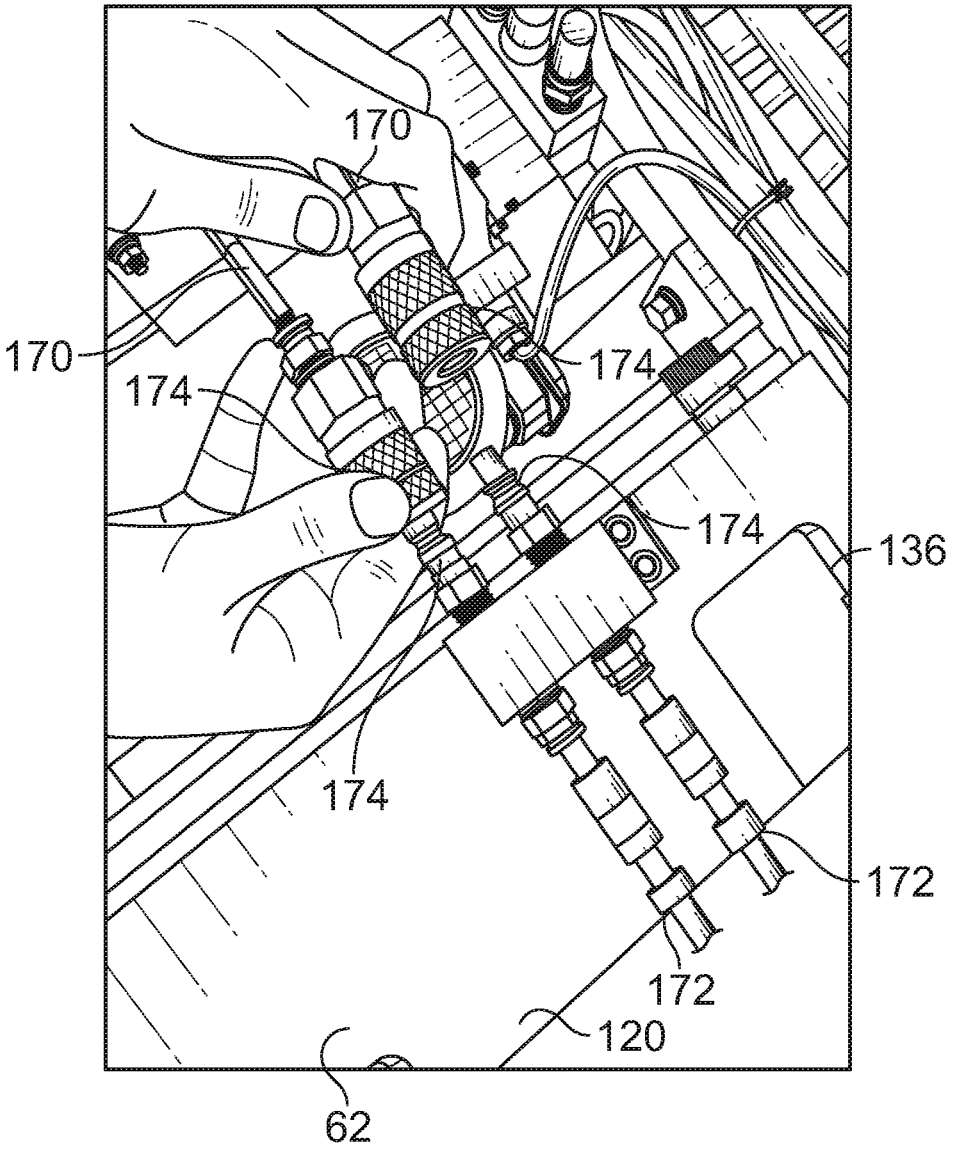
FIGS. 4-7 are perspective views illustrating steps for removing a carriage assembly from a frame structure of the machine of FIG. 1.

FIG. 4 depicts another aspect of the disclosure, wherein pneumatic supply lines 170 are coupled to receiving lines 172 of the first carriage assembly 62 via conventional quick connect elements 174. The two receiving lines 172 are located on the base frame 120 and coupled to the pneumatic piston and cylinder units also on the base frame 120. Air supplied by the lines 172 to the pneumatic piston and cylinder units allow those units to move the active forming elements 161 toward and away from the center point of the first opening 162 during each container forming operation. The receiving lines 172 can be quickly coupled and decoupled from the supply lines 170 via the conventional quick connect elements 174.

The second set of forming components 50', shown in FIG. 9, includes a second mandrel assembly 60' and a second carriage assembly 62'. As will be described in more detail below, the second mandrel assembly 60' and the second carriage assembly 62' form a matched set of second forming components 50', with components having sizes and dimensions that correspond to one another in accordance with an aspect of the disclosure.

The second mandrel assembly 60' includes an elongate second post 70' comprising a rigid member and having opposed first and second end portions 70A', 70B', see FIGS. 9 and 10. The first end portion 70A' includes at least one third attachment member 72' for removably attaching the second mandrel assembly 50' to the frame structure 12 of the machine 10.

In the exemplary embodiment shown in FIGS. 9 and 10, the at least one third attachment member 72' comprises a third mounting member 174' comprising a pair of third mounting member sections 74A', 74B', wherein the third mounting member sections 74A', 74B' are positioned on opposing sides of the second post 70' and coupled together via bolts 74C' so as to be releasably locked in position on the second post 70'.

The second mandrel assembly 60' may be installed in the machine 10 in place of the first mandrel assembly 60 such that the second mandrel assembly 60' engages with the second mounting member 76 of the at least one second attachment member 78. The at least one second attachment member 78 may be positioned in the first forming station 34. At least one fourth attachment member 178 may be positioned in the second forming station 36. In the embodiment illustrated in FIG. 10, the second mandrel assembly 60' including the at least one third attachment member 72' as well as the at least one fourth attachment member 178 are located in the second forming station 36. Hence, with the second mandrel assembly 60' installed in the second forming station 36 of the machine 10, the third mounting member 174' interacts with a fourth mounting member 176 of the at least one fourth attachment member 178. The fourth mounting member 176 is coupled to the first frame element 12A of the frame structure 12 via bolts, welding or the like.

The third mounting member 174', more specifically, the mounting member section 74A', comprises at least one third opening, e.g., two third openings 80A', 80B' as shown in FIGS. 9 and 10, and two additional third openings (not shown) on the opposite side of the mounting member section 74A'. The fourth mounting member 176 includes a corresponding number of second openings 182A, 182B, 182C and 182D, see FIG. 10. The third attachment member 72' further comprises fasteners 84' that pass through the respective second openings 182A, 182B, 182C and 182B in the fourth mounting member 176 and threadedly engage the respective third openings 80A', 80B' in the third mounting member 174' to couple the third mounting member 174' to the fourth mounting member 176.

The at least one third attachment member 72' may further comprise a plate 90' coupled to the third mounting member 174', more specifically, to the mounting member section 74A', via bolts (not shown) that extend through openings 90A' in the plate 90' and engage threaded openings (not shown) in the third mounting member 174', more specifically, the mounting member section 74A', see FIGS. 9 and 10. The plate 90' further comprises at least one bore 92', two bores in the illustrated embodiment. The at least one fourth attachment member 178 further comprises at least one pin 94', two pins in the illustrated embodiment, that extend upward from the fourth mounting member 176, wherein the pins 94' pass through the bores 92' to further couple the third mounting member 174' to the fourth mounting member 176.

The third and fourth attachment members 72', 178 are used to releasably secure the second mandrel assembly 60' to the first frame element 12A, wherein the second post 70' of the second mandrel assembly 60' is arranged generally vertically when installed in the machine 10.

The second mandrel assembly 60' further comprises a second mandrel member 100', see FIGS. 9 and 10. The second mandrel member 100' is affixed to the second end portion 70B' of the second post 70', and comprises, in the illustrated embodiment, a second size and shape different than the first size and shape of the first mandrel member 100. The second size and shape of the second mandrel member 100' are set to or defined by the dimensions of containers to be erected by the second set of forming components 50'. The second mandrel member 100' may be shaped and sized to form containers of any desirable size and shape. In one embodiment, the second mandrel member 100' forms containers having dimensions of from about 4"×3"×1½" to about 10"×7"×5". In general terms, the second mandrel member 100' takes the form of one or more rigid members such as spaced apart end plates or members 100A' and 100B', see FIG. 10, that may define with their bottom surfaces an outline of an area generally corresponding to an outline of a bottom surface or floor of the container or box to be erected.

The second carriage assembly 62' of the second set of forming components 50' comprises a base frame 120'. When the second set of forming components 50' is installed in the machine 10, the base frame 120' is secured to a third frame element 133 of the frame structure 12 in or near the second forming station 36. If the second set of forming components 50' is positioned in the first forming station 34, the base frame 120' is secured to the second frame element 130. The second carriage assembly 62' may be easily inserted into and removed from the frame structure 12 of the machine 10 via rollers 132' associated with the base frame 120', which rollers 132' roll on tracks 137 on the third frame element 133 and another frame element 135, which is generally parallel to the third frame element 133, see FIG. 1. It is noted that the tracks could be located on the base frame 120' with the rollers 132' on the third and other frame elements 133, 135 without departing from the scope and spirit of the invention. Cutout portions 136' formed in the base frame 120' may serve as handholds for moving the second carriage assembly 62' into and out of the machine 10.

A clamp assembly 140' is used to releasably secure the second carriage assembly 62' to the third frame element 133. The clamp assembly 140' comprises a first clamp element 142' mounted to the base frame 120', and a second clamp element (not shown but similar to clamp element 144) mounted to the third frame element 133. Any suitable clamp elements can be used, i.e., the invention is not meant to be limited to any particular type of clamp elements. In the exemplary embodiment shown, the first clamp element 142' comprises a rigid and elongate member 146' that includes a notch 148', which notch 148' is adapted to receive a U-shaped fastening member of the second clamp element. Once the U-shaped fastening member is received in the notch 148', a pivoting handle of the second clamp element is rotated down to tighten the fastening member in the notch 148' and therefore secure the second carriage assembly 62' to the third frame element 133. A second clamp assembly may be used to secure the other side of the second carriage assembly 62' to the other frame element 135. A second elongate member 146' is illustrated on the second carriage assembly 62' shown in FIG. 9.

The second carriage assembly 62' further comprises a plurality of second passive forming elements 160' and second active forming elements 161', wherein the forming elements 160' and 161' are also known in the art as forming shoes, which collectively form a second opening 162' having dimensions corresponding to the second size and shape of the second mandrel member 100' such that the second mandrel member 100' may pass at least part way through the second opening 162'. The second forming elements 160' and 161' have a plurality of entry angles, which help move side walls of a blank to be formed into a container to an upright, generally vertical or erected position as the mandrel member 100' applies a downward force on a blank. Pneumatic piston and cylinders units (not shown) are located on the base frame 120' and coupled to the active forming elements 161' for moving the forming elements 161' toward and away from the center point of the second opening 162' during each container forming operation.

The second carriage assembly 62' is releasably coupled to the first frame element 12A via the third and fourth attachment members 72', 178. As noted above, when the movable plate/nut assembly 182A of the linear actuator assembly 182 is moved up or down in the vertical direction by the motor/gearbox assembly 180, it causes the first frame element 12A and, hence, the second carriage assembly 62' to reciprocate upward and downward with it.

During operation of the machine 10, a blank 200 is moved by the mechanical pusher mechanism over the second carriage assembly 62'. The motor/gearbox assembly 180 is then actuated causing the movable plate/nut assembly 182A of the linear actuator assembly 182 to move downward, resulting in the second mandrel assembly 60' also moving downward. Downward movement of the second mandrel assembly 60' causes the second mandrel member 100' to apply a downward force on the blank forcing the blank through the second opening 162' in the second carriage assembly 62'. As the blank moves through the second opening 162', the second forming elements 160' and 161' cause side walls of the blank to be erected into an upright, generally vertical or erected position so as to form the blank into a container having its upper portion open.

As shown in FIG. 9, the second forming elements 160' and 161' are coupled only to the base frame 120' and not directly coupled to the frame structure 12.

Further pneumatic air supply lines 170 are coupled to receiving lines 172' of the second carriage assembly 62' via conventional quick connect elements 174'. The two receiving lines 172' are located on the base frame 120' and coupled to the pneumatic piston and cylinder units also on the base frame 120'. Air supplied by the lines 172' to the pneumatic piston and cylinder units allow those units to move the active forming elements 161' toward and away from the center point of the second opening 162' during each container forming operation. The receiving lines 172' can be quickly coupled and decoupled from the supply lines 170 via the conventional quick connect elements 174'.

As described above, the first set of forming components 50 may be used in the first forming station 34 and the second set of forming components 50' may be used in the second forming station 36. However, the second set of forming components 50', or another set of forming components, could be selected for use in the first forming station 34 and the first set of forming components 50, or another set of forming components, could be used in the second forming station 36.

The selected one of the first set of forming components 50 or the second set of forming components 50' is coupled to the first forming station 34 of the machine 10 as follows.

The mandrel assembly 60, 60' of the selected set of forming components 50, 50', including the first or second post 70, 70' and the corresponding first or second mandrel member 100, 100', is secured to the first frame element 12A of the machine 10 by securing the at least one first attachment member 72 or the at least one third attachment member 72' to the at least one second attachment member 78 secured to the first frame element 12A. More particularly, the first mounting member 174A or the third mounting member 174' of the selected first or second mandrel assembly 60, 60' is secured to the corresponding second mounting member 76 using the fasteners 84 in the openings 80A, 80B and 82A, 82B, 82C, and 82D or the openings 80A', 80B' and 82A, 82B, 82C and 82D. The mandrel assembly 60, 60' of the selected set of forming components 50, 50' is further secured to the first frame element 12A of the machine 10 by the insertion of the one or more pins 94 of the at least one second attachment member 78 through the corresponding bores 92, 92' formed in the plate 90, 90' of the corresponding first or third attachment member 72, 72'.

The first carriage assembly 62 or the second carriage assembly 62' of the corresponding set of forming components 50, 50' is then secured to the second and other frame elements 130 and 131 of the machine 10, i.e., if the first mandrel assembly 60 is installed in the first forming station 34 of the machine 10, the first carriage assembly 62 is selected for installation into the first forming station 34, and if the second mandrel assembly 60' is installed in the first forming station 34 of the machine 10, the second carriage assembly 62' is selected for installation into the first forming station 34. The selected first or second carriage assembly 62, 62' is rolled into the frame structure 12 using the rollers 132, 132' and tracks 134. Once the selected first or second carriage assembly 62, 62' is in the correct position, e.g., with the member 146, 146' of the first clamp element 142, 142' of the clamp assembly 140, 140' aligned with the fastening member 150 of the second clamp element 144, the clamp assembly 140, 140' is used to secure the first or second carriage assembly 62, 62' to the second frame element 130.

Once the selected first or second carriage assembly 62, 62' is installed into the frame structure 12 in the correct position, the pneumatic air supply lines 170 are coupled to receiving lines 172, 172' of the first or second carriage assembly 62, 62' via quick connect elements 174, 174'.

It is noted that the steps described above for installing the selected mandrel assembly 60, 60' and carriage assembly 62, 62' do not need to be performed in the order outlined above. For example, while the mandrel assembly 60, 60' was described as being installed first, the carriage assembly 62, 62' could be installed before the mandrel assembly 60, 60'.

Once the selected first or second set of forming components 50, 50' is installed in the frame structure 12 of the machine 10, no alignment modifications of the first or the second mandrel assembly 60, 60' and its corresponding first or second carriage assembly 62, 62' are required for the machine 10 to form blanks of fiberboard material into containers having dimensions corresponding to the first or the second size and shape of the installed first or second mandrel member 100, 100'. This advantage is realized due to the size and shape of the first mandrel member 100 being matched with the size and shape of the first opening 162 of the first carriage assembly 62, and the size and shape of the second mandrel member 100' being matched with the size and shape of the second opening 162' of the second carriage assembly 62', i.e., due to the first and second sets of forming components 50, 50' being respective matched sets. This is in contrast with prior art machines, wherein changing out the mandrel member involves removing the mandrel member from the post (not removing the mandrel member with the post from the frame structure as in the present invention) and securing a different mandrel member to the post, wherein alignment modifications are required to be made to the forming elements such that they match the dimensions and position of the mandrel member. In accordance with the invention, such alignment modifications to the forming elements are not necessary.

As noted above, the other of the first or second sets of forming components 50, 50', or another set of forming components, can be selected for use in the second forming station 36. The other set of forming components is installed in the second forming station 36 using the same procedure described above for installing the selected set of forming components in the first forming station 34.

If it is desired to change out the installed set of forming components for a different set of forming components, the process described above is reversed to remove the installed set of forming components, and then the process described above is used to install the next set of forming components in the machine 10. That is, the pneumatic air supply lines 170 are disconnected from the receiving lines 172, 172' of the first or second carriage assembly 62, 62' via the quick connect elements 174, 174', the clamp assembly 140, 140' is used to decouple the selected carriage assembly 62, 62' from the second frame element 130, and the selected carriage assembly 62, 62' is rolled out of the frame structure 12 and the machine 10 using the rollers 132, 132' and tracks 134.

The mandrel assembly 60, 60' is removed from the frame structure 12 of the machine 10 by withdrawing the fasteners 84 from the openings 80A, 80B and 82A, 82B, 82C, 82D in the first and second mounting members 174A, 76 or the openings 80A', 80B' and 82A, 82B, 82C and 82D in the second and third mounting members 76, 174A'. The mandrel assembly 60, 60' is then lifted or pivoted such that the one or more pins 94 of the second attachment member 78 are withdrawn out of the corresponding bores 92, 92' formed in the plate 90, 90' of the corresponding first or third attachment member 72, 72'. The mandrel assembly 90, 90' can then be removed from the frame structure 12 of the machine 10.

The blanks to be formed into containers by the machine 10 are conventional and may take the form of generally flat blanks made of fiberboard material.

In accordance with the invention, if containers of a certain size and shape are being formed by the machine 10, and containers having alternate sizes and/or shapes are desired, the installed set of forming components can be easily and quickly replaced with an alternate set of forming components with an appropriate size and shape to form the containers of the desired size and shape.

While particular embodiments of the present invention have been illustrated and described, it should be understood that various changes and modifications may be made without departing from the spirit and scope of the invention. It is therefore intended to cover in the appended claims all such changes and modifications that are within the scope of this invention.

What is claimed is:

1. A machine that forms blanks of fiberboard material into containers, the machine including removable and interchangeable first and second sets of forming components and receiving one of the first set of forming components or the second set of forming components in a first forming station for use during a forming operation, wherein:

the first set of forming components comprising:

a first mandrel assembly comprising:

an elongate first post having opposed first and second end portions, the first end portion including at least one first attachment member adapted to interact with at least one second attachment member on a first frame element of a frame structure of the machine so as to releasably secure the first mandrel assembly to the first frame element; and a first mandrel member affixed to the second end portion of the first post, the first mandrel member comprising a first size and shape; and a first carriage assembly adapted to be secured to a second frame element of the frame structure of the machine, the first carriage assembly comprising a plurality of first forming elements that collectively form a first opening having dimensions corresponding to the first size and shape of the first mandrel member; and the second set of forming components comprising:

a second mandrel assembly comprising:

an elongate second post having opposed first and second end portions, the first end portion including at least one third attachment member adapted to interact with the at least one second attachment member on the first frame element so as to releasably secure the second mandrel assembly to the first frame element; and a second mandrel member affixed to the second end portion of the second post, the second mandrel member comprising a second size and shape different than the first size and shape; and a second carriage assembly adapted to be secured to the second frame element of the machine, the second carriage assembly comprising a plurality of second forming elements that collectively form a second opening having dimensions corresponding to the second size and shape of the second mandrel member;

one of the first set of forming components or the second set of forming components is coupled to the first forming station of the machine by:

securing the at least one first or the at least one third attachment member of the respective first or second post to the at least one second attachment member of the first frame element of the machine; and securing the corresponding first or second carriage assembly to the second frame element of the machine;

wherein the installed one of the first or the second set of forming components is used during operation of the machine to form blanks of fiberboard material into containers having dimensions corresponding to the first or the second size and shape of the installed first or second mandrel member.

2. The machine according to claim 1, wherein the first and second posts each comprise a rigid member that is arranged generally vertically when installed in the machine, and the first frame element of the machine comprises an elongate generally horizontal beam member.

3. The machine according to claim 1, wherein the at least one first attachment member comprises a first mounting member comprising at least one first opening, the at least one second attachment member comprises a second mounting member including at least one second opening and the at least one third attachment member comprises a third mounting member comprising at least one third opening.

4. The machine according to claim 3, wherein the at least one first attachment member further comprises a fastener that passes through the at least one second opening and threadedly engages the at least one first opening to couple the first mounting member to the second mounting member.

5. The machine according to claim 3, wherein the at least one first attachment member further comprises a plate coupled to the first mounting member, the plate comprising at least one bore and the at least one second attachment member further comprises at least one pin extending from the second mounting member such that the at least one pin passes through the at least one bore to couple the first mounting member to the second mounting member.

6. The machine according to claim 1, wherein each of the first and second carriage assemblies comprises a base frame and rollers coupled to the base frame.

7. The machine according to claim 6, further comprising tracks provided on the frame structure for receiving the rollers of the first and second carriage assemblies to allow the carriage assemblies to be easily inserted into and removed from the frame structure.

8. The machine according to claim 6, further comprising a clamp assembly comprising a first clamp element mounted to each of the base frames of the first and second carriage assemblies and a second clamp element mounted to the second frame element, such that the first or the second carriage assembly is secured to the second frame element of the machine using the clamp assembly.

9. The machine according to claim 1, further comprising a second forming station located adjacent to the first forming station for receiving another set of forming components.

10. The machine according to claim 1, wherein the size and shape of the first mandrel member is matched with the size and shape of the first opening of the first carriage assembly and the size and shape of the second mandrel member is matched with the size and shape of the second opening of the second carriage assembly such that, when the first or the second set of forming components is installed in the machine, no alignment modifications of the first or the second mandrel assembly and its corresponding first or second carriage assembly are required for the machine to form blanks of material into containers.

11. A machine that forms blanks of fiberboard material into containers comprising:

a frame structure; and a mandrel assembly comprising:

an elongate post having opposed first and second end portions, the first end portion including at least one first attachment member coupled with at least one second attachment member on a first frame element of the frame structure so as to releasably secure the mandrel assembly to the first frame element;

the at least one first attachment member comprises a first mounting member comprising at least one first opening and the least one second attachment member comprises a second mounting member including at least one second opening; and a first mandrel member affixed to the second end portion of the first elongate post.

12. The machine according to claim 11, wherein the at least one first attachment member further comprises a fastener that passes through the at least one second opening and threadedly engages the at least one first opening to couple the first mounting member to the second mounting member.

13. The machine according to claim 11, wherein the at least one first attachment member further comprises a plate coupled to the first mounting member, the plate comprising at least one bore, and the at least one second attachment member further comprises at least one pin extending from the second mounting member such that the at least one pin passes through the at least one bore to couple the first mounting member to the second mounting member.

14. A machine that forms blanks of fiberboard material into containers, the machine comprising:

a frame structure;

a mandrel assembly coupled to a first frame element of the frame structure and comprising a mandrel member having a first size and shape, a carriage assembly releasably secured to a second frame element of the frame structure, the carriage assembly comprising a removable base frame to which a plurality of first forming elements are coupled and that collectively form an opening having dimensions corresponding to the first size and shape of the mandrel member, a clamp assembly comprising a first clamp element mounted to the base frame of the carriage assembly and a second clamp element mounted to the second frame element, such that the carriage assembly is secured to the second frame element via the clamp assembly.

15. The machine according to claim 14, wherein carriage assembly further comprises rollers coupled to the base frame.

16. The machine according to claim 15, wherein the frame structure further comprises tracks for receiving the rollers of the carriage assembly to allow the carriage assembly to be easily inserted into and removed from the frame structure.

17. The machine according to claim 14, wherein the plurality of first forming elements are coupled only to the base frame and not directly coupled to the frame structure.

18. A method of modifying a machine that forms blanks of fiberboard material into formed containers, the method comprising:

removing a first mandrel assembly from a first frame element of a frame structure of the machine, the first mandrel assembly comprising:

an elongate first post having opposed first and second end portions, the first end portion including at least one first attachment member that is removably coupled to at least one second attachment member coupled to the first frame element so as to releasably secure the first mandrel assembly to the first frame element; and a first mandrel member affixed to the second end portion of the first post, the first mandrel member comprising a first size and shape;

wherein the first mandrel assembly is removed from the first frame element by decoupling the at least one first attachment member from the at least one second attachment member; and securing a second mandrel assembly to the at least one second attachment member of the first frame element of the machine, the second mandrel assembly comprising:

an elongate second post having opposed first and second end portions, the first end portion including at least one third attachment member that is capable of being removably coupled to the at least one second attachment member of the first frame element so as to releasably secure the second mandrel assembly to the first frame element; and a second mandrel member affixed to the second end portion of the second post, the second mandrel member comprising a second size and shape different than the first size and shape;

wherein the second mandrel assembly is secured to the first frame element by coupling the at least one third attachment member to the at least one second attachment member.

19. The method of claim 18, wherein the first post is a different post from the second post.

20. A method of modifying a machine that forms blanks of fiberboard material into formed containers, the method comprising:

removing a first carriage assembly from a frame structure of the machine, the first carriage assembly comprising a removable first base frame to which a plurality of first forming elements are coupled and that collectively form a first opening having dimensions corresponding to a size and shape of a corresponding first mandrel member, wherein the first carriage assembly is removed from the frame structure by withdrawing the first base frame with the plurality of first forming elements coupled to the first base frame from the frame structure such that the first forming elements do not need to be individual decoupled from the frame structure; and securing a second carriage assembly to the frame structure of the machine in place of the first carriage assembly, the second carriage assembly comprising a removable second base frame to which a plurality of second forming elements are coupled and that collectively form a second opening having dimensions corresponding to a second size and shape of a corresponding second mandrel member, wherein the second carriage assembly is secured to the frame structure by inserting the second base frame with the plurality of second forming elements coupled to the second base frame into the frame structure and securing the second base frame to the frame structure such that the second forming elements do not need to be individual secured to the frame structure or positionally adjusted on the second base frame.

21. The method according to claim 20, wherein the first carriage assembly is removed from the frame structure of the machine by rolling the first carriage assembly on rollers and the second carriage assembly is inserted into the machine in place of the first carriage assembly by rolling the second carriage assembly on rollers.

22. The machine according to claim 21, wherein the rollers are provided on the frame structure.

23. The machine according to claim 21, wherein the rollers are provided on the first and second base frames.

* * * * *